US009701428B2

(12) United States Patent
Weiby et al.

(10) Patent No.: US 9,701,428 B2
(45) Date of Patent: Jul. 11, 2017

(54) APPARATUS FOR TENSIONING A CABLE LACING TAPE DEVICE

(71) Applicant: IDEAL Industries, Inc., Sycamore, IL (US)

(72) Inventors: Michael Richard Weiby, Barlett, IL (US); Steven Luigi Lollino, Hawthorn Woods, IL (US); John James Apida, St. Charles, IL (US); Ian Robert Rittof, Waterman, IL (US); James Ray Falotico, St. Charles, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 0 days.

(21) Appl. No.: 15/009,258

(22) Filed: Jan. 28, 2016

(65) Prior Publication Data

US 2016/0236804 A1 Aug. 18, 2016

Related U.S. Application Data

(60) Provisional application No. 62/108,871, filed on Jan. 28, 2015.

(51) Int. Cl.

| | |
|---|---|
| ***B65B 13/22*** | (2006.01) |
| ***B65B 13/02*** | (2006.01) |
| ***B26D 1/06*** | (2006.01) |
| *B26D 7/14* | (2006.01) |

(52) U.S. Cl.

CPC ..... *B65B 13/22* (2013.01); *B26D 1/065* (2013.01); *B65B 13/027* (2013.01); *B26D 7/14* (2013.01)

(58) Field of Classification Search

CPC ..... B65B 13/18; B65B 13/22; B65B 13/027; B21F 9/02; B65D 63/14; B65D 63/16; B65D 7/14; B26D 7/08; B26D 7/14; B26D 1/065; B25B 25/00

USPC ..... 100/29, 32; 140/93.2, 123.6

See application file for complete search history.

(56) References Cited

U.S. PATENT DOCUMENTS

| | | | | |
|---|---|---|---|---|
| 3,735,784 | A | 5/1973 | Obuch et al. | |
| 4,328,742 | A | 5/1982 | Discavage | |
| 4,498,506 | A | 2/1985 | Moody et al. | |
| 5,205,328 | A * | 4/1993 | Johnson | B65B 13/027 140/93 A |
| 5,595,220 | A | 1/1997 | Leban et al. | |
| 6,302,157 | B1 | 10/2001 | Deschenes et al. | |

(Continued)

FOREIGN PATENT DOCUMENTS

WO 2013/003471 A1 1/2013

OTHER PUBLICATIONS

ISA/US, International Search Report and Written Opinion issued on PCT application No. US2016/015391, dated Mar. 29, 2016, 9 pages.

*Primary Examiner* — Jimmy T Nguyen

(74) *Attorney, Agent, or Firm* — Greenberg Traurig, LLP

(57) ABSTRACT

An apparatus for tensioning a material includes a housing, a spur shaft reciprocally coupled to the housing, a trigger operably coupled to the housing and to the spur shaft to effect translation of the spur shaft when the trigger is operably moved, a tensioning device mounted to the housing and operably coupled to the spur shaft such that translation of the spur shaft causes operation of the tensioning device, and a passage having an inlet and an outlet, the passage operably coupling the inlet and outlet to the tensioning device.

14 Claims, 14 Drawing Sheets

(56) References Cited

U.S. PATENT DOCUMENTS

| | | | | |
|---|---|---|---|---|
| 6,648,378 | B1 | 11/2003 | Torres et al. | |
| 7,185,680 | B2 * | 3/2007 | Magno, Jr. | B65B 13/027 140/123.6 |
| 7,231,944 | B2 * | 6/2007 | Magno, Jr. | B65B 13/027 140/123.6 |
| 2005/0115629 | A1 | 6/2005 | Bernard | |
| 2009/0242069 | A1 | 10/2009 | Segroves | |

* cited by examiner

APPARATUS FOR TENSIONING A CABLE LACING TAPE DEVICE

CROSS REFERENCE TO RELATED APPLICATION

This application is a non-provisional application claiming priority from U.S. Provisional Application Ser. No. 62/108,871, filed Jan. 28, 2015, entitled "Apparatus for Tensioning a Cable Lacing Tape Device" and incorporated herein by reference in its entirety.

FIELD OF THE DISCLOSURE

The present description relates generally to the installation of a cable lacing tape and more particularly to an apparatus for tensioning a cable lacing tape device.

BACKGROUND OF RELATED ART

Cable lacing tapes may be used for a variety of applications. Modern cable lacing tapes typically are a thin, relatively flat, woven or braided cord, often referred to as a "tape", having filaments that may be made of materials such as Nylon, polyester, or NOMEX®, and which may be impregnated with coatings to enhance particular performance characteristics. However, cable lacing tape has drawbacks in that the cable lacing tape typically is tied by hand in a costly, labor-intensive, and time-consuming process. Due to these problems, several attempts have been made to automate the cable lacing and tensioning process.

One such device for automated knot tying is described in U.S. Pat. No. 6,648,378. The described device includes an automatic knot-tying device for tying a discrete knot about a workpiece, such as a bundle of wires. The device works by pulling a lacing tape, transversely around the workpiece and wrapping the filament around the workpiece. A shuttle moves the filament between carriage rings and along the workpiece at the appropriate steps, and a plurality of hooks pull the filament away from the workpiece at the appropriate steps. The operation is finished by cinching, cutting, and reloading so that the resulting knot is discrete and secure. At least one drawback of the described device is that it requires a complicated mechanism to both wrap and tie a knot about the workpiece.

In still another example, International Application Number PCT/US2012/044413, describes a hand held tool for tensioning and severing a cable tie. The device includes a reciprocating tensioning mechanism such as a pawl link for tensioning the cable tie tail, a locking mechanism to prevent further tensioning upon the attainment of a preselected tension level in the tie tail, and a severing device to sever the tie tail from the cable tie head once installed.

DETAILED DESCRIPTION

The following description of example methods and apparatus is not intended to limit the scope of the description to the precise form or forms detailed herein. Instead the following description is intended to be illustrative so that others may follow its teachings.

Copending U.S. patent application Ser. Nos. 14/223,685 and 14/527,214, each of which is incorporated by reference in its entirety, both generally disclose a cable lacing tie for holding a plurality of objects together. The disclosed cable lacing tape devices generally include a head assembly and a length of cable lacing tape that can be retained by the head assembly upon activation of the retaining device. In the disclosed example devices, a free end of the cable lacing tape is routed (generally be hand) through an opening in the head around retainer, which is actuatable from an unlocked position to a locked position by pulling the free end of the cable lacing tape with sufficient force.

In at least some instances, the example cable lacing tie devises comprise of a length of woven aramid fiber tape with a synthetic rubber coating attached to a polymer fastener. While the free end must be activated with sufficient force to actuate the retainer, this tape material may be difficult to grip by hand and furthermore may be difficult to grip mechanically utilizing the standard cam action of existing cable tie guns due to the coating acting as a dry lubricant as well as the abrasive nature of the aramid fiber.

It has been found that a directional change and/or folding of the lace assists in the grip allowing the tool to build tension in the lace. This tension is required to both activate the retainer in the fastener head as well as activate the cutting action in the tool linkage.

Figure 1:
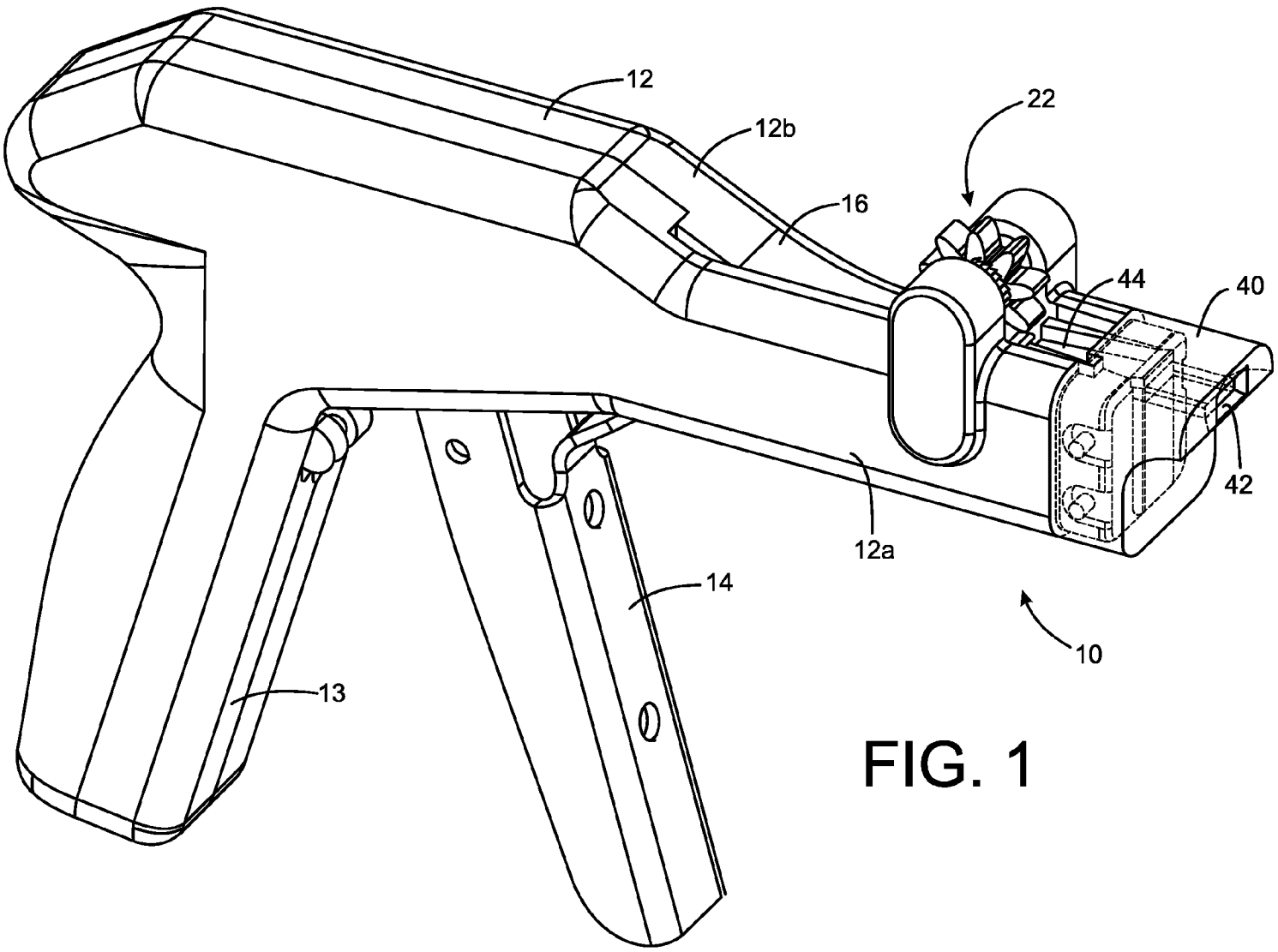
FIG. 1 is a perspective view of an example apparatus for tensioning a cable lacing tape device as disclosed herein.
Figure 2:
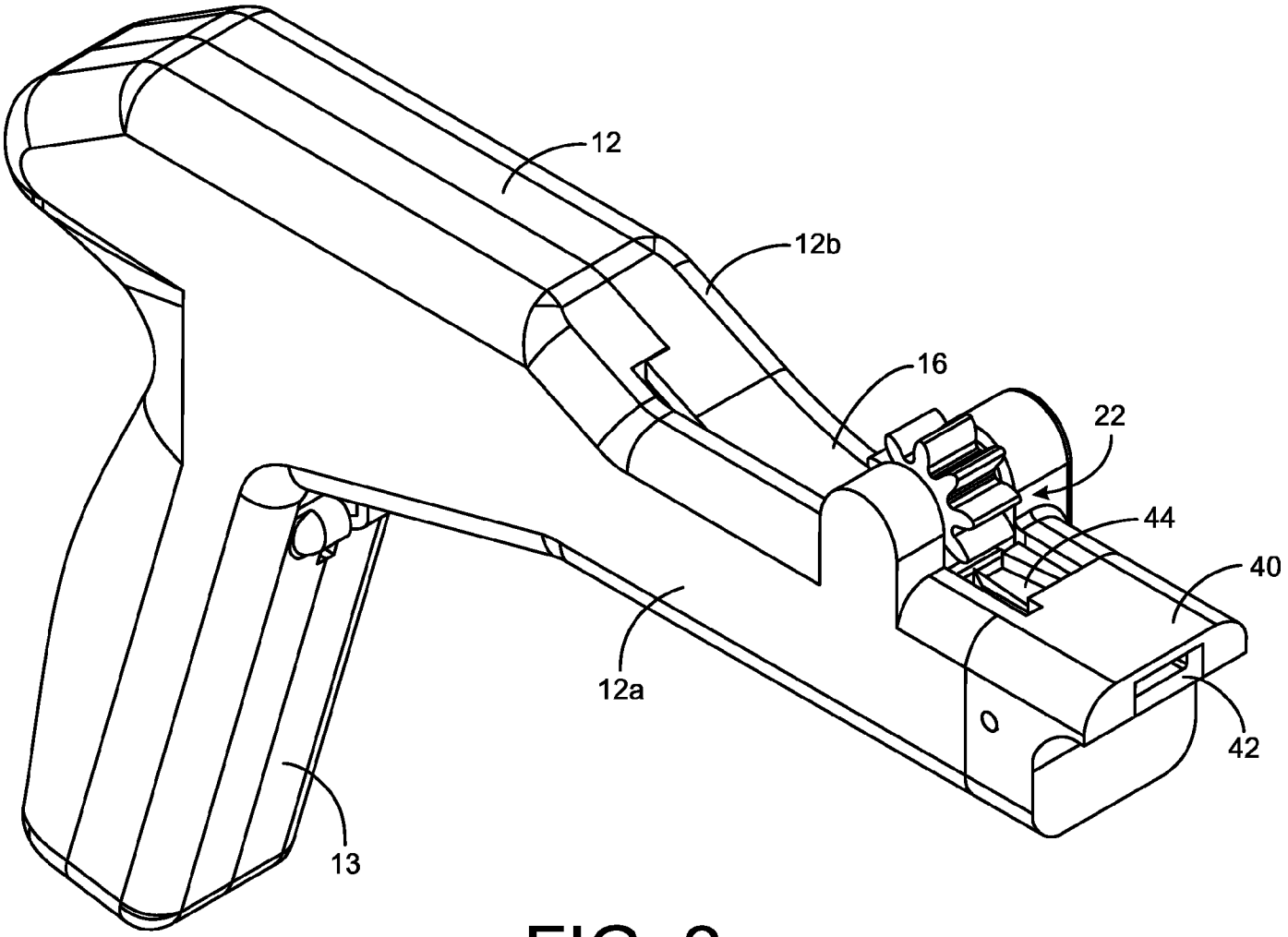
FIG. 2 is a perspective view of the example apparatus of FIG. 1 with the handle assembly removed.
Figure 3:
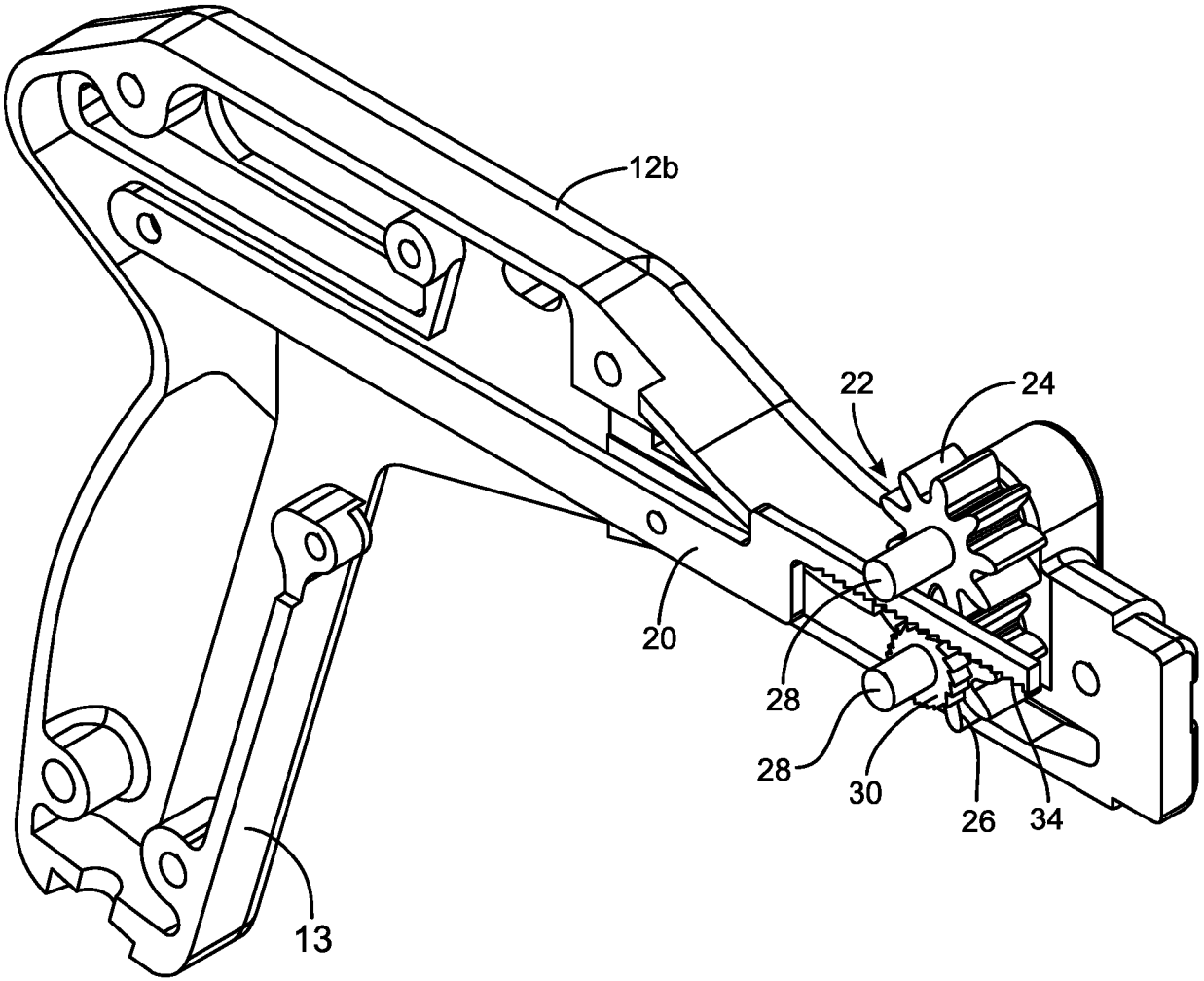
FIG. 3 is a perspective view of the example apparatus of FIG. 2 with one sidewall of the housing removed.
Figure 4:
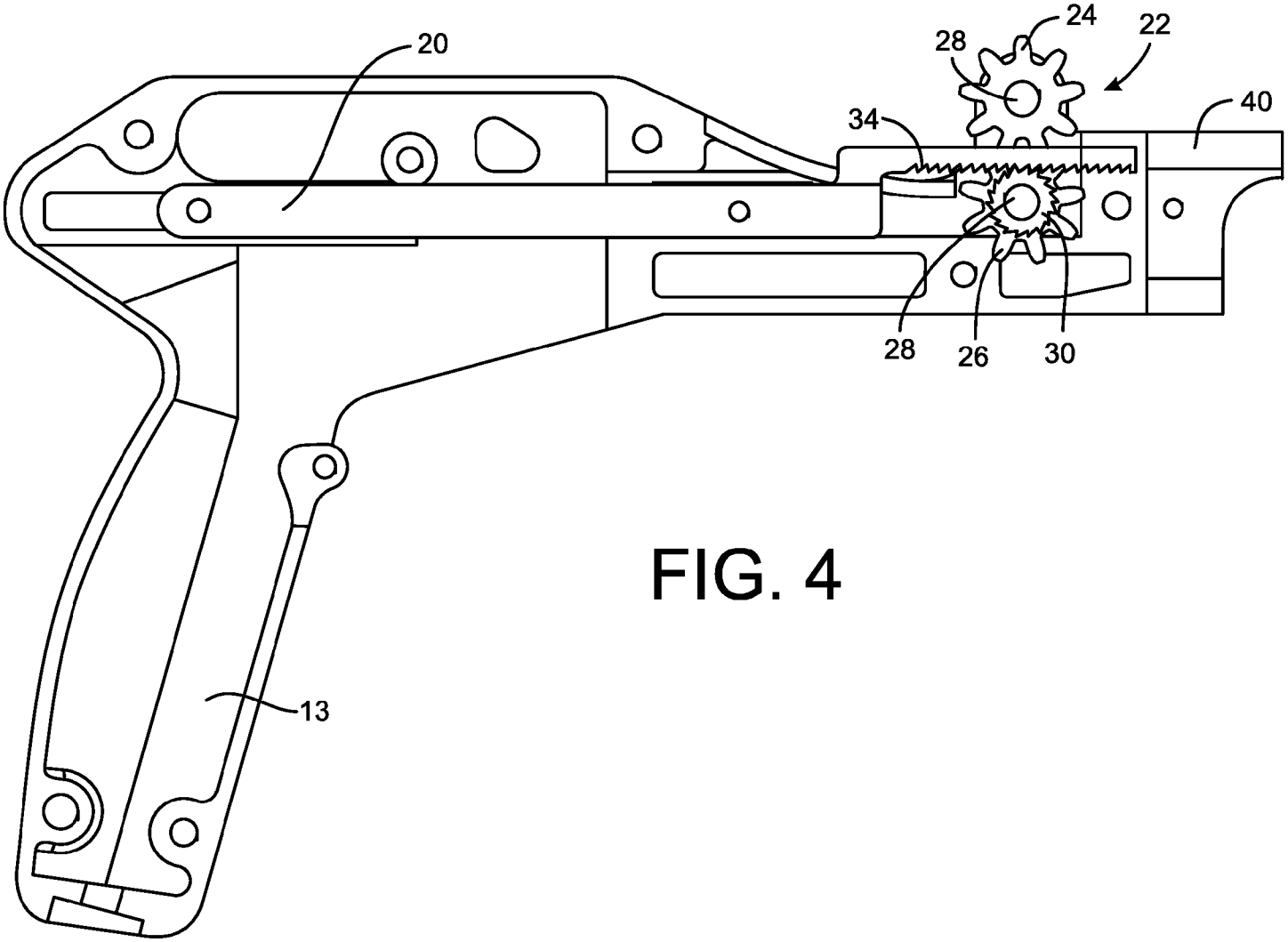
FIG. 4 is a side elevational view of the apparatus of FIG. 3.

Referring now to the figures, an example apparatus 10 for tensioning a cable lacing tape device, such as the cable lacing tape device 5 (see FIG. 6), is illustrated. As described herein, the example apparatus may also cut or otherwise trim a free end of the cable lacing tape once a predetermined tension is achieved. The example apparatus 10 includes a housing 12 in the general shape of a pistol or gun having a grip 13, trigger 14, and a barrel portion 16. As illustrated in FIG. 3, one sidewall 12*a* of the housing 12 has been cut away to show the other housing sidewall 12*b* and the internal parts and mechanism of the apparatus 10.

The apparatus 10 generally comprises a reciprocating spur shaft 20 and a tensioning assembly 22, formed by a pair of meshed gears 24, 26 each rotatably mounted within the barrel portion 16 of the housing 12. For instance, in one example, each of the gears 24, 26 includes a mounting shaft 28 that is rotatably retained within apertures defined by each respective housing sidewall 12*a*, 12*b*, such that when the two housing sidewalls 12*a*, 12*b* are coupled together, the gears 24, 26 are secularly maintained by the housing 12. In still other examples, at least one of the housing sidewalls 12*a*, 12*b*, may define each of the gear shafts 28 to allow the gears 24, 26 to be mounted on the shafts as desired.

Figure 5:
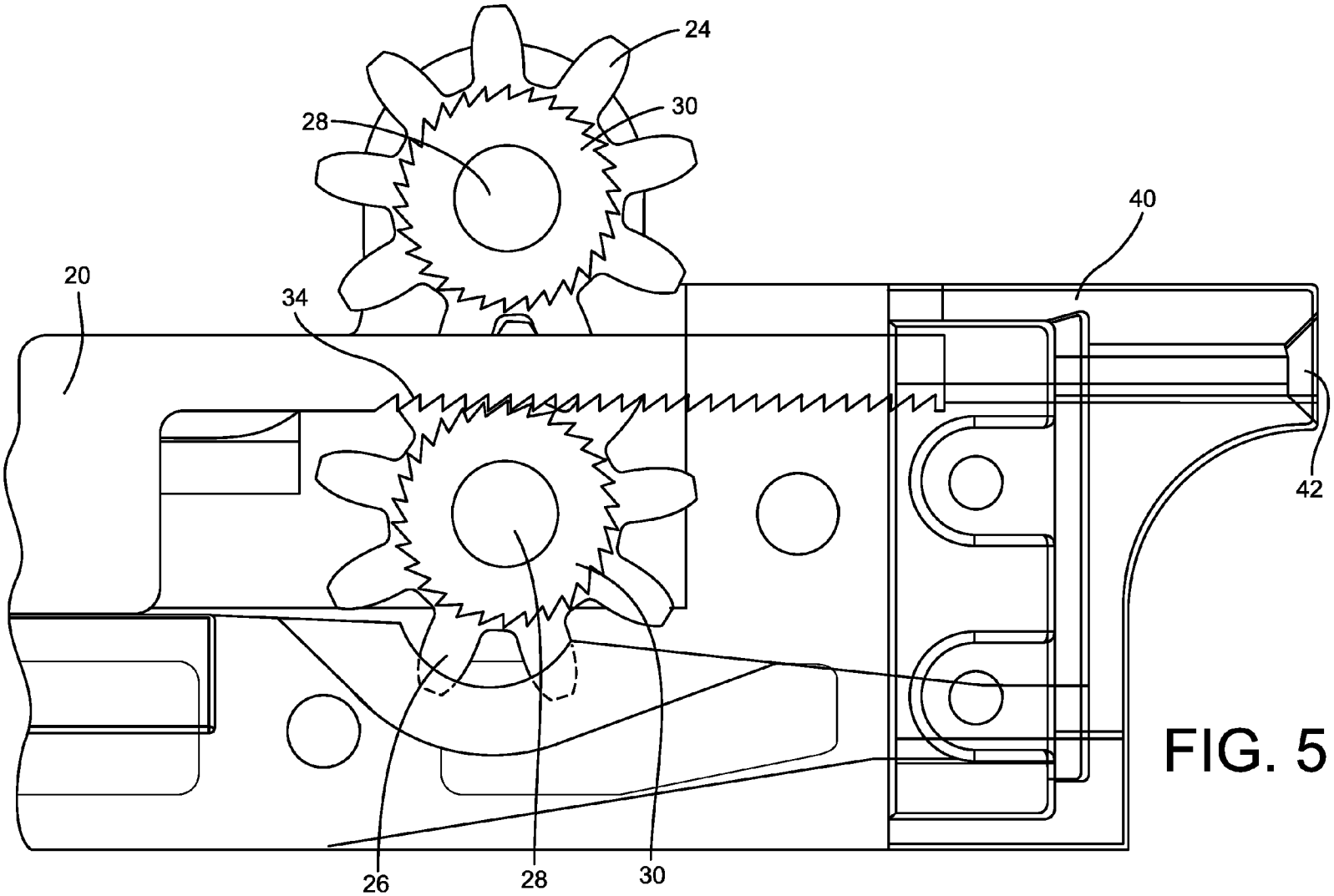
FIG. 5 is an enlarged elevational view of the gripping portion of the example apparatus of FIG. 4.

In the illustrated example, at least one of the gear 24, 26 also, includes a ratchet hub 30 coaxially mounted on the shaft 28. As shown in the attached drawings, only one of the gears, gear 26, includes the ratchet hub 30, but it will be appreciated by one of ordinary skill in the art that either or both of the gears 24, 26 may include a ratcheting hub as desired (see for example, FIG. 5). In this example, the two spurs gears 24, 26 are substantially the same size, but it will be understood that the gears 24, 26 may be different types, such as for instance rack and pinion, helical, worm, etc., and/or may be different sizes as desired. Still further, one or both of the gears 24, 2 may be mounted with a one way clutch to prevent the gears 24, 26 from rotating in the opposite direction, ensuring the retention of the tensile force in the cable lacing tape generated by previous strokes.

As best seen in FIGS. 3, 4, 5, 8, 9, the example ratchet hub 30 includes a plurality of ratcheting teeth 32 that cooperate with corresponding ratchet teeth 34 disposed along the reciprocating spur shaft 20. The teeth 32, 34 are aligned such that reciprocating movement of the spur shaft 20 causes the gear 26 to move in one direction, which in turn causes the meshed gear 24 to rotate correspondingly. As previously noted, the gear 24 may also or alternatively include a ratchet hub and be operatively coupled to the spur shaft 20 as desired. The increase in diameter of the gear profile in relation to the ratchet hub as well as the multiple folds in the lace between the gear profile results in 3-4 times the "take-up" or length of lace pulled through the gripper gears 24, 26 when compared to the strictly linear action of a traditional cable tie gun.

As noted, the spur shaft 20 is reciprocally mounted within the housing 12 and operatively coupled to the gears 24, 26 via the ratcheting teeth 34 at one end, and operatively coupled to the trigger 14 such that movement of the trigger 14 relative to the grip 13 causes the shaft 20 to translate within the housing 12. In this example, the trigger 14 is pivotally moved towards the grip 13, although other movements may be utilized as desired. As will be appreciated, when translating relative to the housing 12, the spur shaft 20 will cause movement rotational movement of the gears 24, 26 through the coupling of the ratcheting teeth 30, 34 as described above.

As shown in at least FIGS. 1, 4, 5, 6, and 19, an nose piece 40 may be provided at the distal end of the barrel portion 16. In this example, the nose piece 40 defines an aperture 42 through which a cable lacing tape may be threaded. The aperture 42 is in alignment and communication with an aperture and/or channel 44 that leads to proximate to a meshing point of the gears 24, 26.

Figure 6:
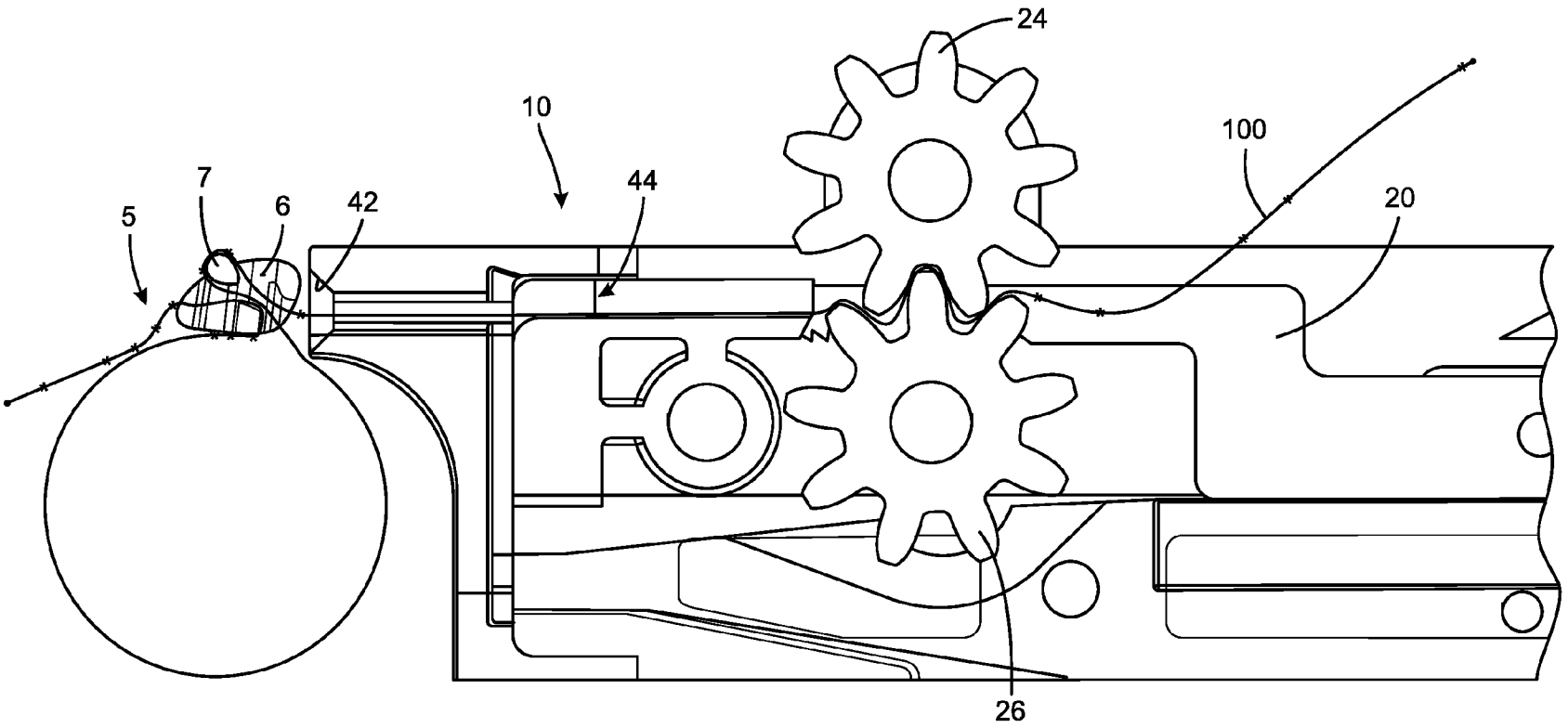
FIG. 6 is an enlarged elevational view of the apparatus of FIG. 5, showing the apparatus is operation with an example cable lacing tie device.
Figure 9:
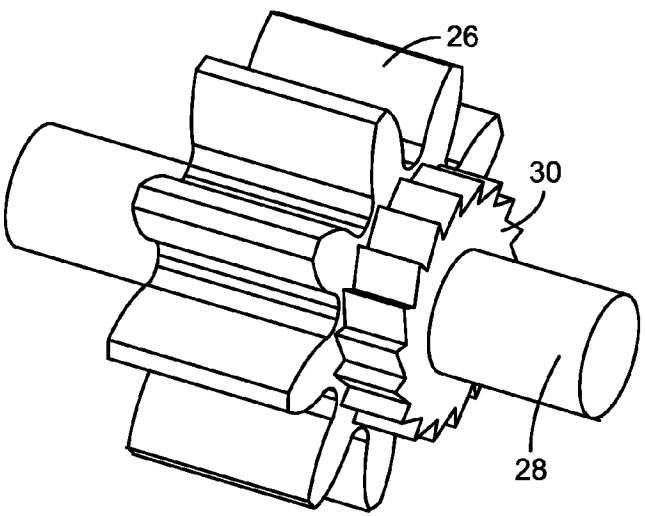
FIG. 9 is a rear perspective view of the example spur gear of FIG. 7.
Figure 8:
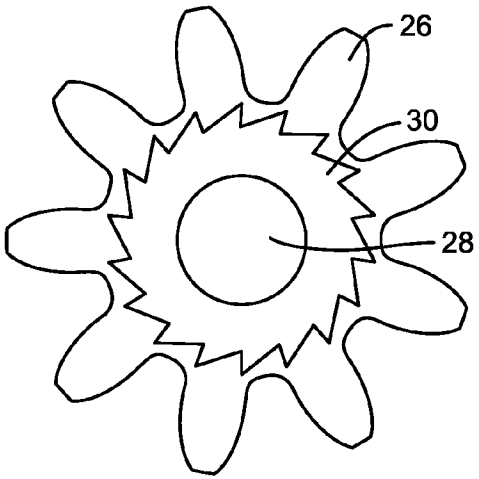
FIG. 8 is a side elevational view of the example gear of FIG. 7.
Figure 7:
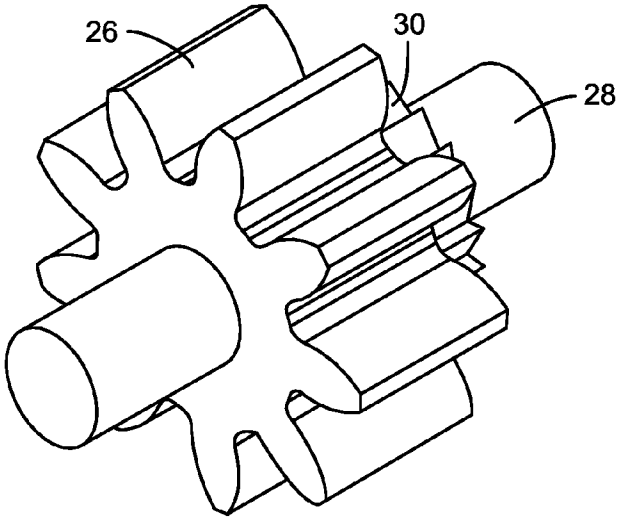
FIG. 7 is a front perspective view of an example spur gear for use with the example apparatus of FIG. 1.
Figure 11:
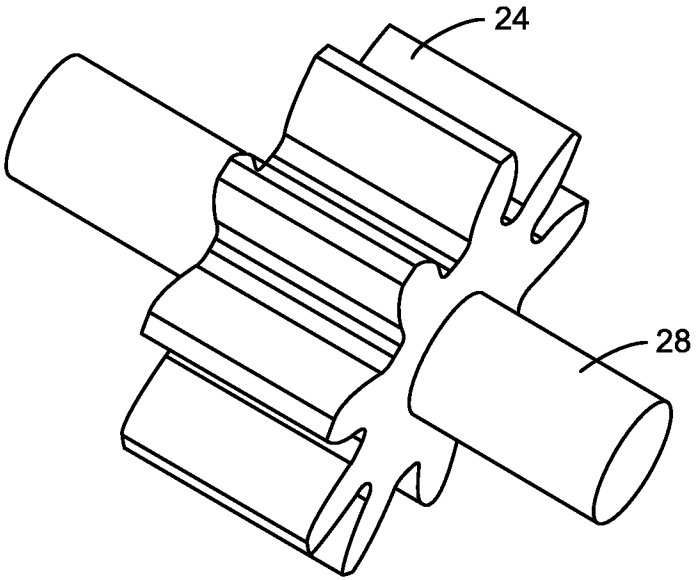
FIG. 11 is a rear perspective view of the example spur gear of FIG. 10.
Figure 10:
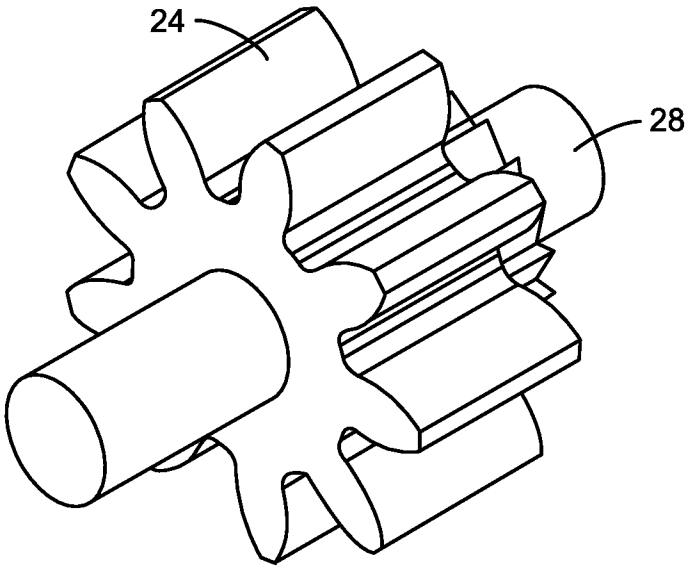
FIG. 10 is a front perspective view of an example spur gear for use with the example apparatus of FIG. 1.
Figure 12:
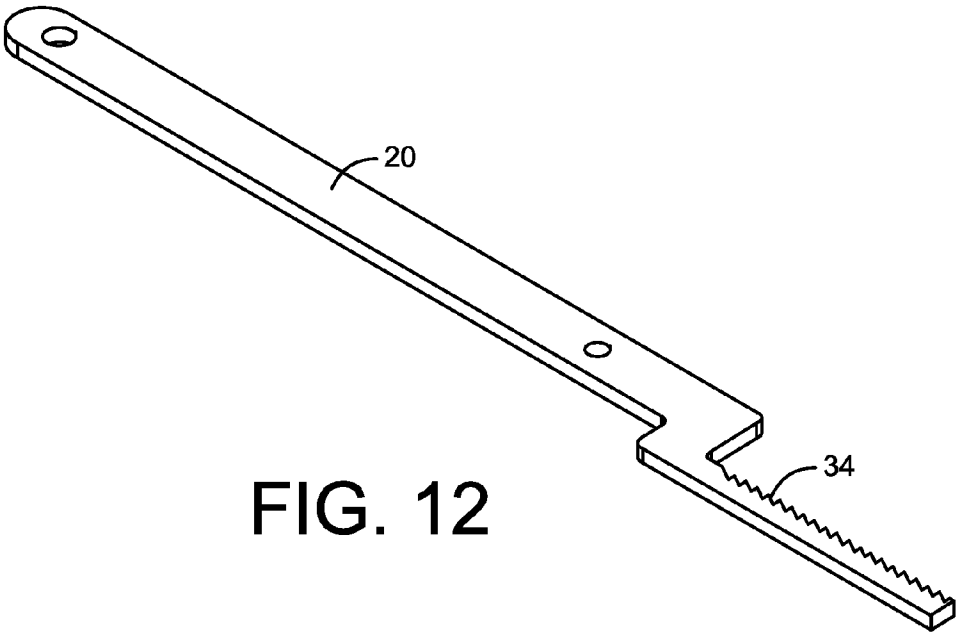
FIG. 12 is a perspective view of an example reciprocating spur shaft for use with the example apparatus of FIG. 1.
Figure 13:
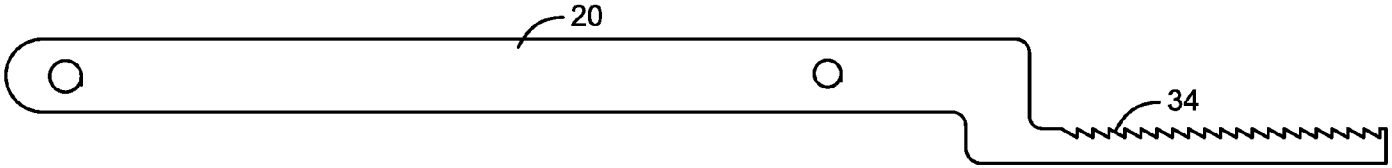
FIG. 13 is a side elevational view of the example shaft of FIG. 12.
Figure 16:
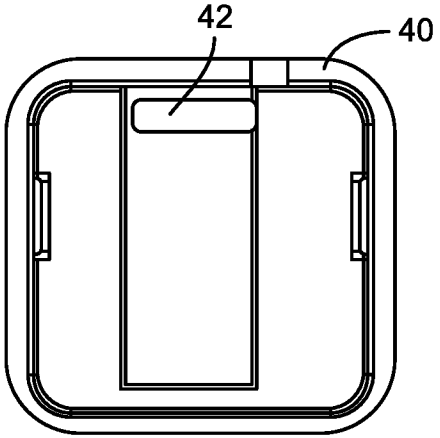
FIG. 16 is a rear elevational view of the nose cap of FIG. 14.
Figure 15:
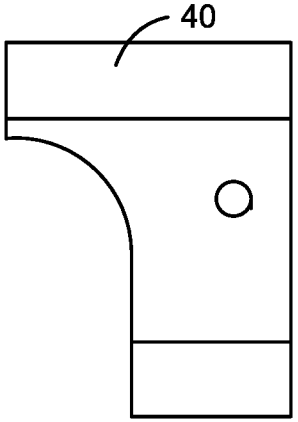
FIG. 15 is a side elevational view of the nose cap of FIG. 14.
Figure 14:
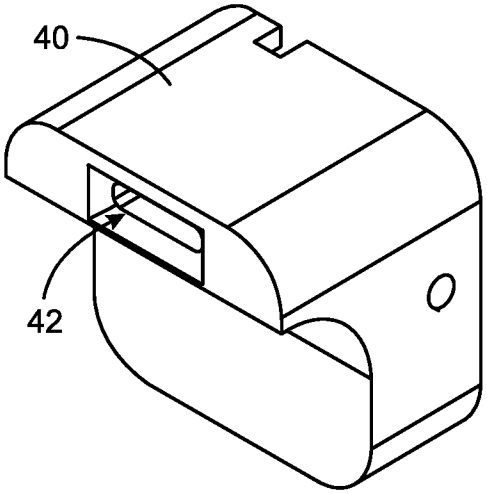
FIG. 14 is a front perspective view of an example nose cap for use with the example apparatus of FIG. 1.
Figure 17:
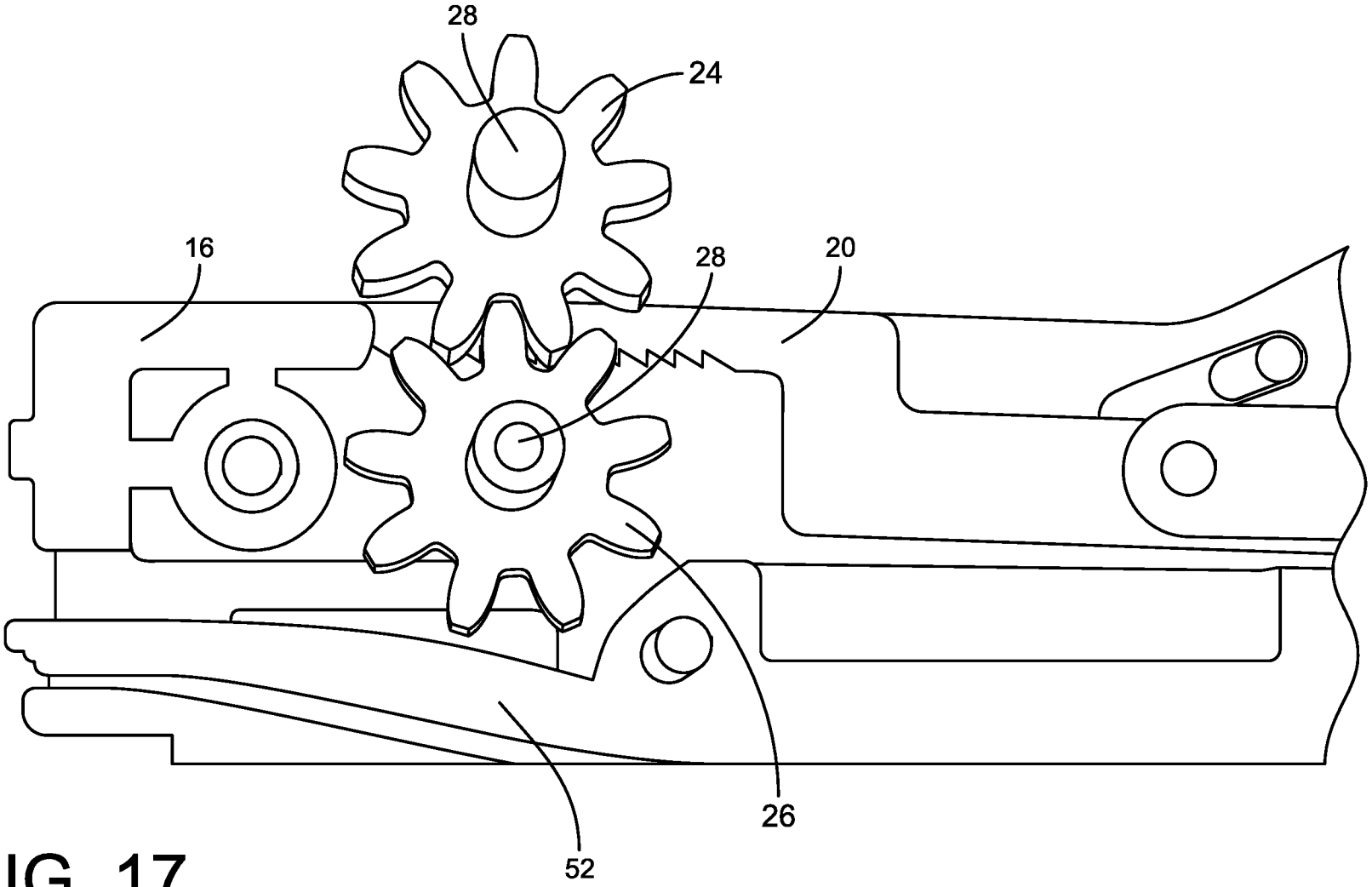
FIG. 17 is a partial side elevational view of the example apparatus of FIG. 1 showing an optional cutting device.

As illustrated in FIG. 6, in operation the apparatus 10 is capable of applying a tensioning force to a free end 100 of the cable lacing tape device 5. For instance, in this example, the free end 100 is fed through the aperture 42 in the nose piece 40 and into the channel 44 proximate the meshing point of the gears 24, 26. The trigger 14 may then be actuated so as to translate the spur shaft 20, thereby rotating the gears 24, 26 so as to feed the free end 100 through the gears 24, 26. As previously noted, the grip on the example cable lacing tape 100 is enhanced once folded and or placed in a directional change, and thus the tortuous path of the free end 100 through the gears 24, 26, allows the apparatus 10 to maintain a grip on the free end 100. Thus, as the trigger 14, the spur shaft 20 and the gears 24, 26 are repeatedly actuated, the free end 100 of the cable lacing tape 5 feeds through the gears 24, 26 and out of the housing 12 as illustrated. It will be understood that the nose piece 40 may also rest against a head portion 6 of the cable lacing tape device 5, thereby causing tension in the free end 100. With the example cable lacing tape 5, once a predetermined tension is achieved in the free end 100, a retainer 7 is activated within the head portion 6, and the cable lacing tie device 5 is actuated into the locked position.

Figure 18:
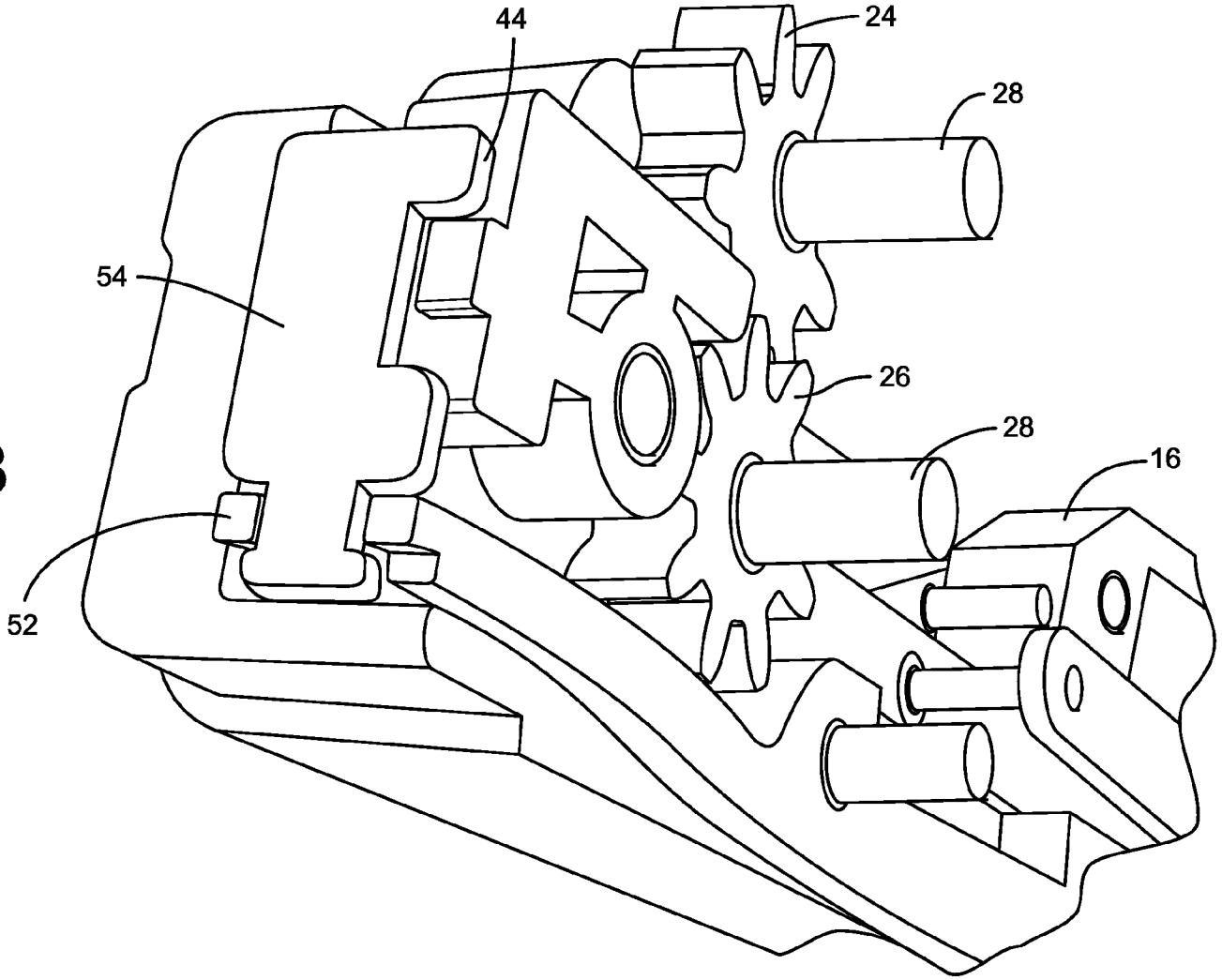
FIG. 18 is a partial front perspective view of the example apparatus of FIG. 17.
Figure 19:
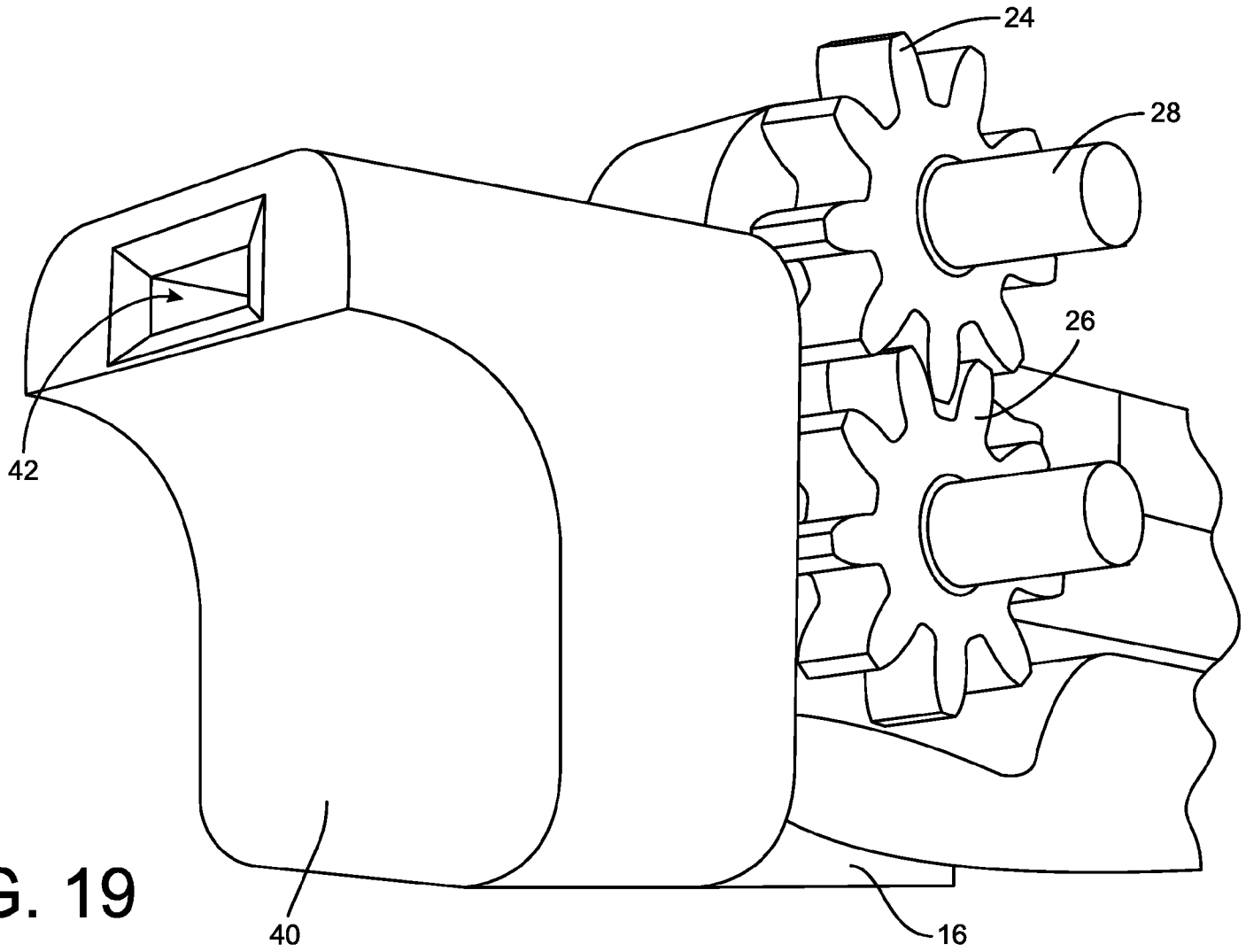
FIG. 19 is a partial front perspective of the example apparatus of FIG. 18 including an installed nose cap.

Upon achieving a locked position, the apparatus 10 may then sever, trim, or otherwise cut the free end 100 of the cable lacing tie device 5 proximate to the head portion 6. In particular, as illustrated in FIGS. 17-20, the apparatus 10 may include an optional cutting device 50, comprising a cutter bar 52 pivotally mounted within the housing 12, and a knife 54 operatively coupled to the cutter bar 52 and reciprocally mounted to the barrel portion 16 proximate the nose piece 40 (FIGS. 18, 19). In this example, when activated, the knife 54 is moveable into the path of the tensioned free end 100 as it is located within the aperture 42 and the channel 44, thereby cutting the tensioned free end 100.

More specifically, the knife 54 sits inside the nose piece 40 and is activated by a cutter bar 52 that is attached to a biasing force, such as a spring 60, which in this example is located within the grip 13 of the apparatus 10, and indirectly attached to the cutter bar 52 via a pivotal rocker 62. As can be appreciated, the spring 60 may be selectively adjusted by an adjustment mechanism 64 to change the biasing force applied by the spring 60 to the rocker 62. For instance, the example spring 60 is located within the grip 13 and is overcome (thus activating the rocker 62) when the tension on the free end 100 reaches a predetermined tension, which in this instance is greater than the tension required to actuate the retainer 7 within the device 5. As a result, the apparatus 10 will both tension and securely actuate the device 5, and further cut the excess tape from the free end 100.

Figure 20:
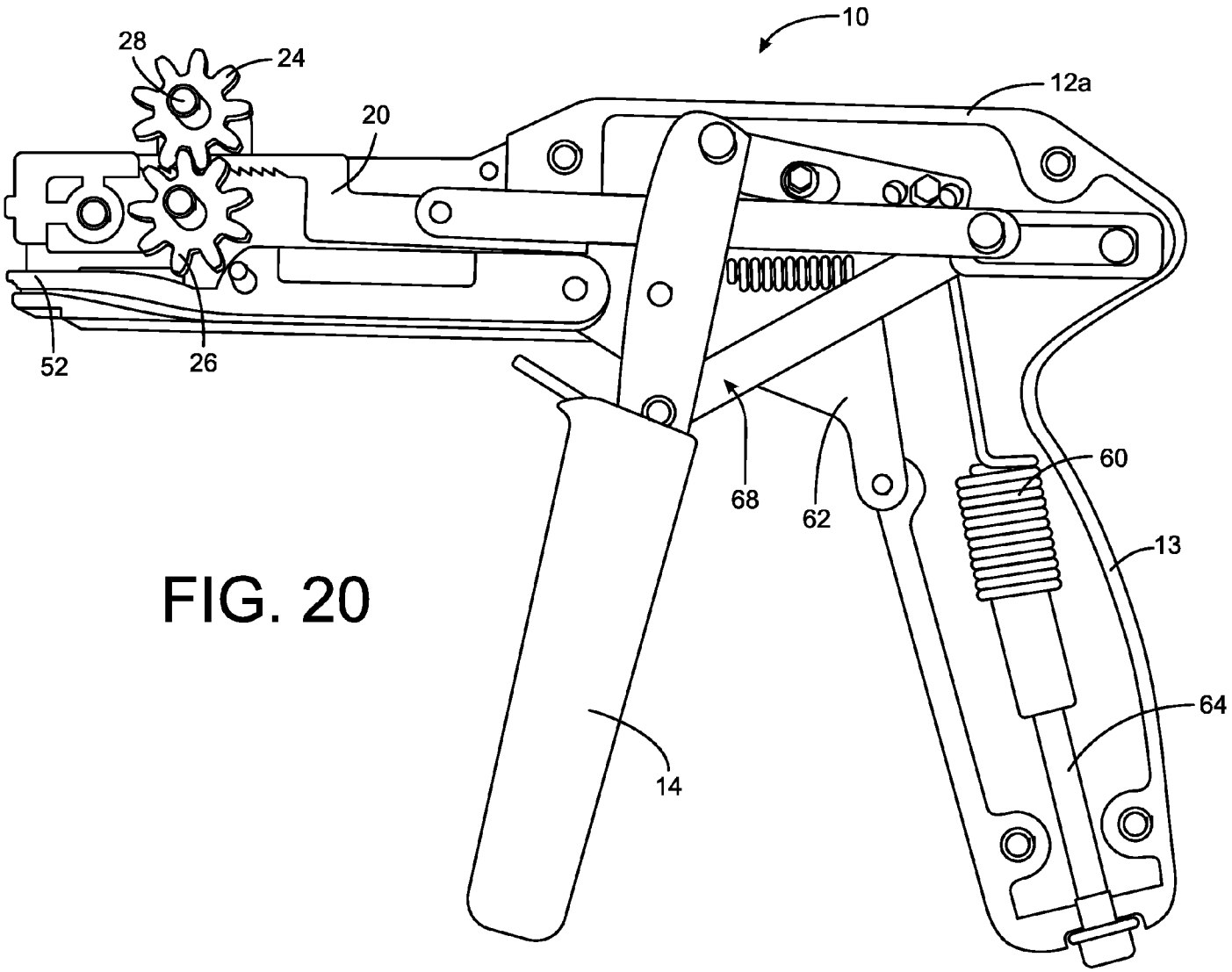
FIG. 20 is a side elevational view of the example apparatus of FIG. 17.

Still referring to FIG. 20, it will be appreciated that the trigger 14 is illustrated as being operably coupled to the spur shaft 20 via a linkage assembly 68. As can be seen, the trigger 14 is pivotally mounted to the housing 12, and is coupled to the end of the spur shaft 20 such that movement of the trigger 14 towards the grip 13 will move the spur shaft linearly within the housing 12, thus activating the gear assembly 22 as previously described. A biasing element, such as a spring 70, may assist in returning the trigger 14 away from the grip 13. As noted above, returning the trigger 14 away from the grip 13 activates the ratcheting system of the spur shaft 20 and the gear assembly 22.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

We claim:

1. An apparatus for tensioning a material comprising:

a housing;

a spur shaft reciprocatingly translatably coupled to the housing;

a trigger operably coupled to the housing and to the spur shaft to effect translation of the spur shaft when the trigger is moved between a first position and a second position relative to the housing;

a tensioning device mounted to the housing and operably coupled to the spur shaft such that translation of the spur shaft causes operation of the tensioning device, the tensioning device comprising a plurality of meshed gears, wherein at least one of the plurality of meshed gears is rotatably coupled to the housing and comprises a plurality of ratcheting teeth, wherein the spur shaft further comprises a plurality of ratcheting teeth operably coupled to the ratcheting teeth of the meshed gear to effect rotation of the coupled meshed gear in a single rotational direction; and a passage having an inlet and an outlet, the passage operably coupling the inlet and outlet to the tensioning device.

2. The apparatus of claim 1, wherein the housing further comprises a grip and a barrel portion.

3. The apparatus of claim 2, wherein the trigger is pivotably coupled to the housing and wherein the first position is distally located from the grip portion and the second position is proximally located to the grip portion.

4. The apparatus of claim 1, wherein the passage comprises a tortuous path defined between the plurality of meshed gears.

5. The apparatus of claim 1, further comprising a cutting device operably coupled to the housing to impinge the passage.

6. The apparatus of claim 5, wherein the cutting device is a knife.

7. The apparatus of claim 5, wherein the cutting device is mounted proximate the inlet.

8. The apparatus of claim 5, wherein the cutting device comprises a cutter bar pivotally mounted to the housing and a knife operably coupled to the cutter bar and reciprocally mounted within the housing.

9. The apparatus of claim 8, wherein the cutter bar is biased.

10. The apparatus of claim 9, wherein the cutter bar is biased by a spring mounted within the grip.

11. An apparatus for tensioning a cable tape comprising:

a housing;

a spur shaft reciprocatingly coupled to the housing;

a trigger operably coupled to the housing and to the spur shaft to effect translation of the spur shaft when the trigger is moved between a first position and a second position relative to the housing;

a gear assembly comprising a pair of meshed gears mounted to the housing and operably coupled to the spur shaft such that translation of the spur shaft causes rotation of the gear assembly, wherein the gear assembly comprises a plurality of ratcheting teeth and wherein the spur shaft comprises a plurality of ratcheting teeth and wherein the ratcheting teeth of the spur shaft are operably coupled to the ratcheting teeth of the gear assembly to effect rotation of the gear assembly in a single rotational direction; and a passage having an inlet and an outlet, the passage operably coupling the inlet to the outlet through a tortuous path defined by the coupling of the meshed gears, wherein rotation of the gear assembly causes the cable tape inserted into the passage to move from the inlet to toward the outlet through the tortuous path of the meshed gears.

12. The apparatus of claim 11, wherein the trigger is pivotably coupled to the housing and wherein the first position is distally located from the grip portion and the second position is proximally located to the grip portion.

13. The apparatus of claim 11, further comprising a cutting device operably coupled to the housing to trim the cable tape inserted into the passage.

14. The apparatus of claim 13, wherein the cutting device comprises a cutter bar pivotally mounted to the housing and a knife operably coupled to the cutter bar and reciprocally mounted within the housing.

* * * * *